United States Patent [19]

Peers

[11] Patent Number: 4,566,747

[45] Date of Patent: Jan. 28, 1986

[54] ELECTRICAL CONNECTION SYSTEM

[75] Inventor: Robert P. Peers, Rochester, Mich.

[73] Assignee: Microdot Inc., Darien, Conn.

[21] Appl. No.: 634,605

[22] Filed: Jul. 26, 1984

[51] Int. Cl.[4] ..... H01R 13/635

[52] U.S. Cl. ..... 339/74 R; 339/258 R

[58] Field of Search ..... 339/74 R, 258 R, 258 S, 339/256 R

[56] References Cited

U.S. PATENT DOCUMENTS

| | | | |
|---|---|---|---|
| 3,206,715 | 9/1965 | Skony | 339/258 R |
| 3,312,931 | 4/1967 | Keller | 339/258 R |
| 3,842,396 | 10/1974 | Olsson | 339/258 P |
| 4,448,468 | 5/1984 | Coldren | 339/74 R |
| 4,458,971 | 7/1984 | D'Urso et al. | 339/74 R |

*Primary Examiner*—John McQuade

*Attorney, Agent, or Firm*—Lyman R. Lyon

[57] ABSTRACT

An electrical connection system is disclosed comprising a female connector that accepts a complementary male post terminal. The female connector has an elastically deformable locking tab therein that locks into the male terminal. An insulating housing on said female connector is movable relative to both said female connector and said male terminal to effect disassociation therebetween.

6 Claims, 4 Drawing Figures

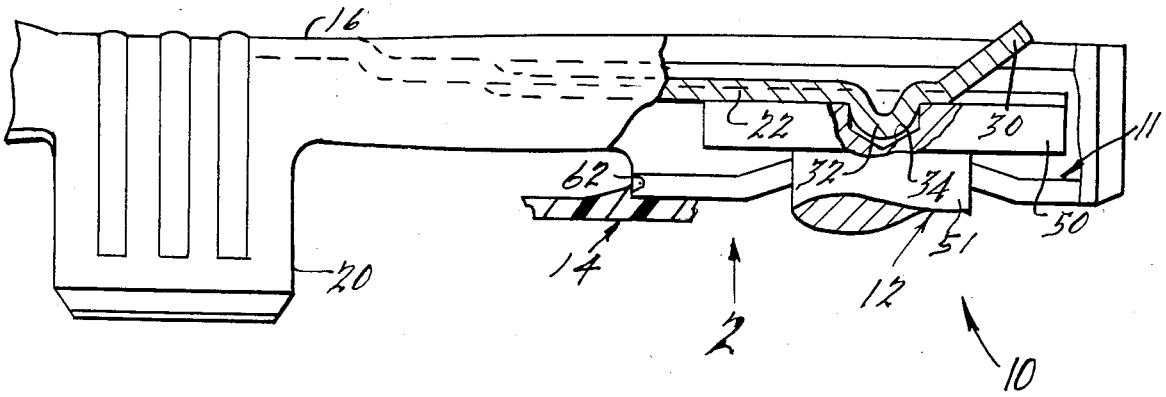
FIG. 1.
FIG. 2.
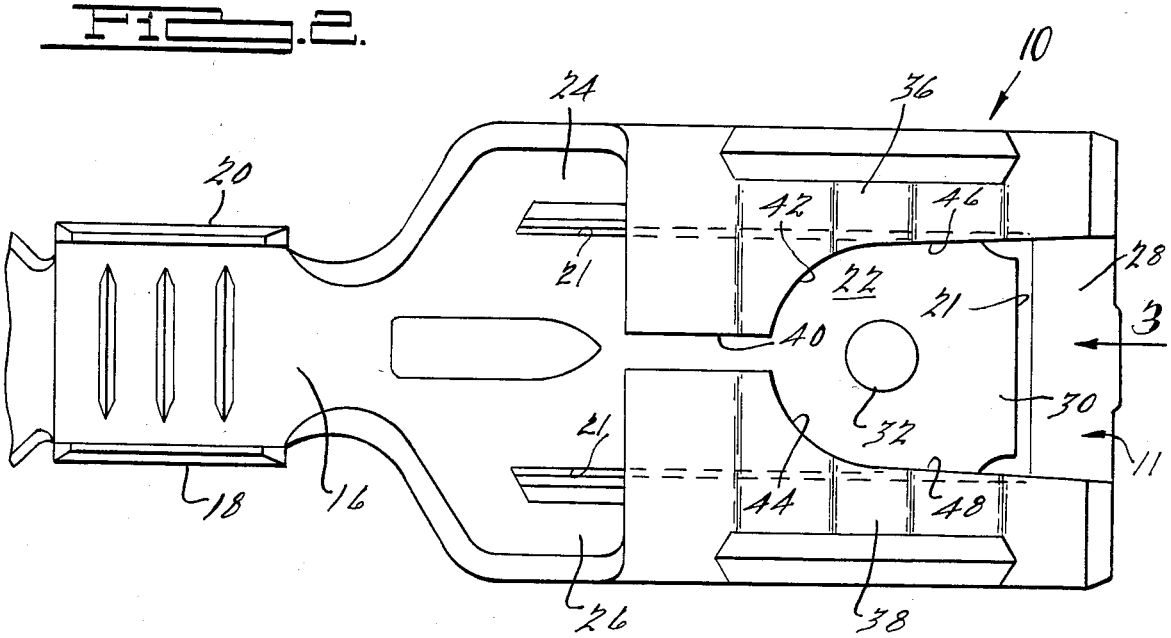
FIG. 3.
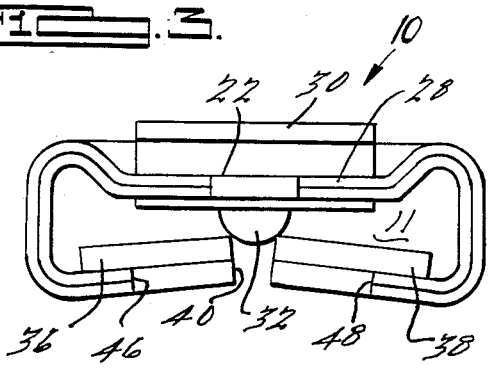
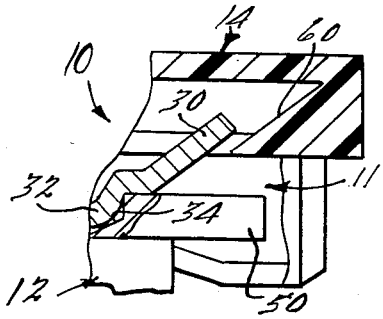
FIG. 4.

ELECTRICAL CONNECTION SYSTEM

BACKGROUND OF THE INVENTION

This invention relates to an electrical connection system of the type disclosed in application Ser. No. 464,623, filed Feb. 7, 1983, for Electrical Terminal which is assigned to the assignee of the instant invention.

Conventional electrical connection systems for mechanically and electrically connecting a flexible electrical conductor to a fixed terminal have not fully solved the problem of attaching a flexible conductor at a right angle to a rigid post. Problems incident to this type of connection relate to assembly difficulties, deformation of the female connector upon tensioning of the flexible conductor, and difficulty in effecting disconnection.

SUMMARY OF THE INVENTION

The electrical connection system of the present invention comprises a female connector for a flexible conductor that accepts a post-type male terminal. Specifically, the male terminal comprises a post having a flanged head with which the complementary female connector interlocks so as to extend at a right angle thereto. An insulating housing functions to substantially enclose and insulate the male and female terminals and to facilitate dissassembly of the terminals. The female terminal is of hollow parallelepiped configuration, one wall of which comprises an elastically deformable tab provided with a detent engageable in complementary cavity in the end of the male terminal. Tension on the flexible conductor secured to the female connector will not release the female connector from the male terminal. However, movement of the female connector housing relative to the male terminal and flexible conductor in the direction of tension on the flexible conductor will effect release of the female connector.

BRIEF DESCRIPTION OF THE DRAWINGS

FIG. 1 is a side elevational view, partially in section, of the electrical connection system of the instant invention;

FIG. 2 is a view taken in the direction of the arrow 2 of FIG. 1 with the male terminal removed;

FIG. 3 is a view taken in the direction of the arrow 3 of FIG. 2; and FIG. 4 is a fragmentary view showing the housing for the connector.

DETAILED DESCRIPTION OF THE PREFERRED EMBODIMENT OF THE INVENTION

Referring to FIG. 1, a female connector 10, of parallelepiped cross section has an open end 11 adapted to receive a post-type male terminal 12. An insulating housing 14 (FIG. 4) provides for insulation and protection of the connector 10 and terminal 12 and facilitates disassembly thereof as will be described.

The post-type male terminal 12 is adapted to be secured to a rigid conductor (not shown). The female connector 10 is adapted to be attached to the free end of a flexible conductor (not shown), a top wall portion 16 in conjunction with a pair of foldable tabs 18 and 20 thereon adapted to be crimped to the conductor.

The top wall 16 of the female connector 10 has a generally U-shaped cutout or slit 21 therein that defines the periphery of a cantilevered central tab 22. The tab

22 is separated from two side edges 24 and 26, and a front edge 28 of the top wall 16 by the slit 21. A free end portion 30 of the tab 22 is bent upwardly at substantially a 45° angle to the remaining portion of the tab 22 to facilitate assembly with and disassembly from the male terminal 12, as will be described. It is to be noted that the tab 22 is cantilevered from the wire gripping end toward the open end 11 of the female connector 10.

The tab 22 immediately adjacent the free end portion 30 thereof is provided with a substantially hemispherical detent 32 that effects a mechanical lock with a complementary cavity 34 in the male terminal 12. It is to be noted that normal tension on a conductor attached to the female connector 10 will not effect release thereof from the male terminal 12.

The bottom wall of the parallelepiped female connector 10, as seen in FIG. 2 of the drawing, comprises two symmetrical pressure plates 36 and 38 separated by a slot 40. The slot 40 is relatively narrow at the wire gripping end of the female connector 10 but intersects two divergent arcuate edge segments 42 and 44 leading into slightly divergent edge portions 46 and 48, respectively. The arcuate segments 42 and 44 as well as the divergent portions 46 and 48 define a passage for the acceptance of the male terminal 12.

As best seen in FIG. 1, the male terminal 12 comprises an annular flange 50 at the top of a post 51 of relatively smaller diameter so as to define a T-shaped cross section. The post 51 of the male terminal 12 is acceptable between the edges 46 and 48 of the pressure plates 36 and 38, respectively. The flange 50 is acceptable between tab 22 and the pressure plates 36 and 38. The diameter of the flange 50 is greater than the spacing of the edges 46 and 48 of the female connector 10 to preclude disassembly thereof from the male terminal 12 in a direction parallel to the central axis thereof. As discussed hereinbefore, the male terminal 12 has a cavity 34 in the flange 50 for the acceptance of the detent 32 on the tab 22 of the female connector 10 to preclude inadvertent dissembly therebetween due to tension on the connector 10 at a right angle to the terminal 12.

As best seen in FIG. 4, the insulating housing 14 is provided with a cam face 60 at one end thereof that is engageable with the front edge 30 of the tab 22, upon movement of the insulator 14 toward the flexible conductor attachment end of the connector 10, to effect upward movement of the tab 22, as seen in the drawing, and disengagement of the detent 32 thereon from the cavity 34 in the male terminal 12. Movement of the insulator 14 in the opposite direction is limited by a shoulder 62 thereon that is engageable with the pressure plates 36 and 38.

While the preferred embodiment of the invention has been disclosed, it should be appreciated that the invention is susceptible of modification without departing from the scope of the following claims.

I claim:

1. An electrical connection system comprising a fixed post-type male terminal having a T-shaped end portion defined by a post having a relatively larger diameter flange at the end thereof, and a female connector of hollow parallelepiped configuration comprising a top wall, a bottom wall and spaced side walls defining an opening for the acceptance of the flange of said male terminal, the bottom wall of said female connector comprising two spaced cutout portions for the acceptance of the post of the male terminal, the spacing of the cutouts in the bottom wall of said female connector being smaller than the flange on the end portion of said male terminal to preclude movement of the female connector away from the male terminal in a direction parallel to a central longitudinal axis of said male terminal, said female connector having means at one end thereof for attachment to a flexible electrical conductor and an elastically deflectable locking tab in the top wall thereof provided with means engageable with said male terminal to effect locking therewith.

2. A connection system in accordance with claim 1 wherein the flange of said male terminal has a cavity therein and the tab of said female connector has a detent acceptable in said cavity.

3. A connection system in accordance with claim 2 including an insulating housing having a cam at one end engageable with the tab on said female terminal to effect retraction of the detent thereon from the cavity in said male terminal.

4. A connection system in accordance with claim 3 wherein the tab on said female connector has an end portion extending toward the opening at the other end of said connector and inclined away from an end face on said male terminal, the cam on said housing extending generally parallel to the end portion of said tab.

5. A connection system in accordance with claim 1 wherein said tab is cantilevered, a free end of said tab overlying said male terminal and the fixed end thereof being disposed at the end of said female connector opposite to the opening therein.

6. A connection system in accordance with claim 3 wherein said cam is interposed between the tab on said female connector and the end face of the flange on said male terminal.

* * * * *